United States Patent [19]

Ferry

[11] 4,023,947

[45] May 17, 1977

[54] AMBIENT AIR ASSIST FOR A REFRIGERATOR UNIT

[76] Inventor: Everett B. Ferry, P.O. Box 382, Montpelier, Vt. 05602

[22] Filed: Jan. 27, 1976

[21] Appl. No.: 652,926

[52] U.S. Cl. ..... 62/180; 62/203; 62/332; 62/409; 62/412; 165/16; 236/49

[51] Int. Cl.[2] ..... F25D 14/08

[58] Field of Search ..... 236/91 R, 91 A, 49; 165/16; 62/180, 203, 208, 332, 409, 410, 411, 412, 235; 98/33 A

[56] References Cited

UNITED STATES PATENTS

| | | | |
|---|---|---|---|
| 1,053,443 | 2/1913 | Scott | 62/235 X |
| 2,067,959 | 1/1937 | Wasson | 236/49 |
| 2,855,839 | 10/1948 | Teigen | 98/33 A |

*Primary Examiner*—Ronald C. Capossela
*Attorney, Agent, or Firm*—A. Yates Dowell, Jr.

[57] ABSTRACT

An apparatus for simultaneously monitoring the temperature within a refrigerated enclosure and the temperature of the ambient air exteriorly of the enclosure which functions to shut down normal compressor operations and selectively activates one or more primary and auxiliary ambient air inlet supply units dependent upon the temperature of the ambient air when the ambient air temperature is below the temperature within the enclosure.

7 Claims, 3 Drawing Figures

FIG. 1
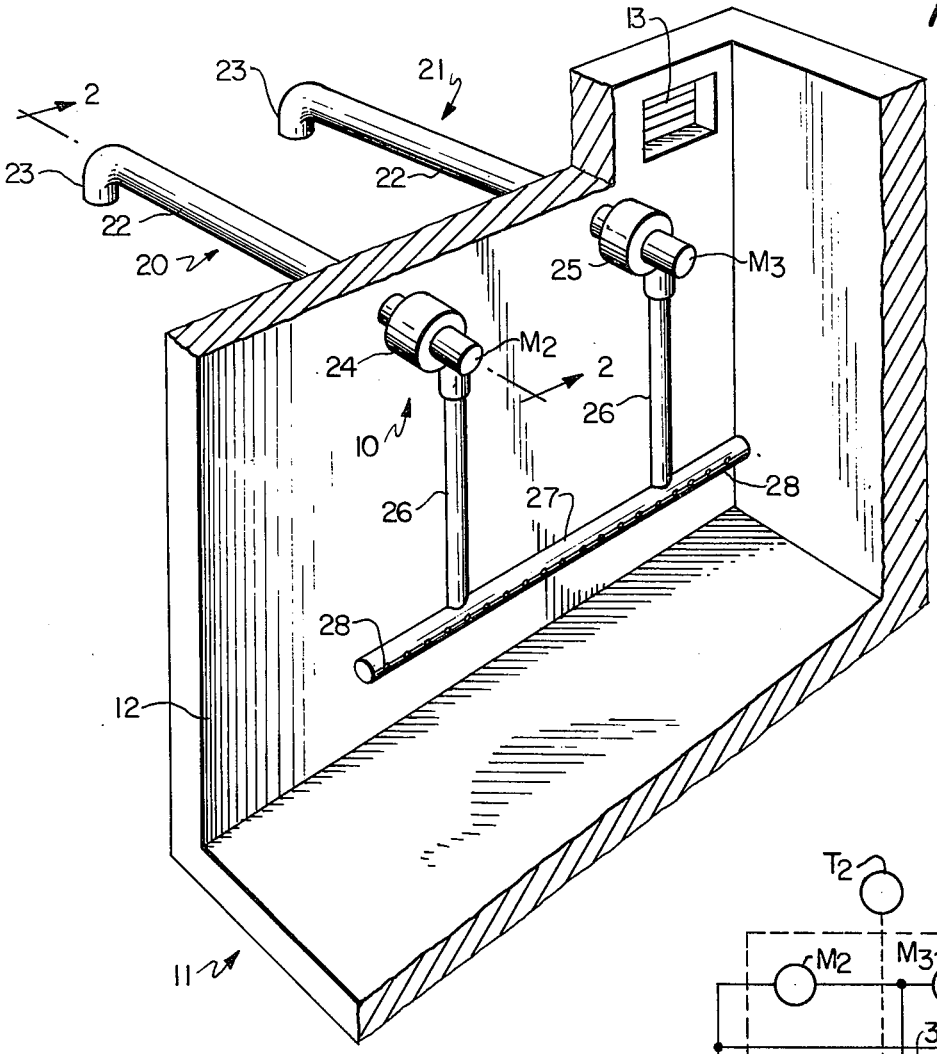
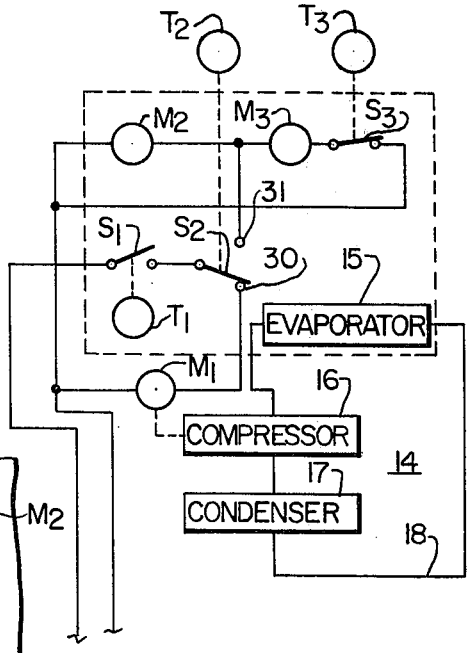
FIG. 2
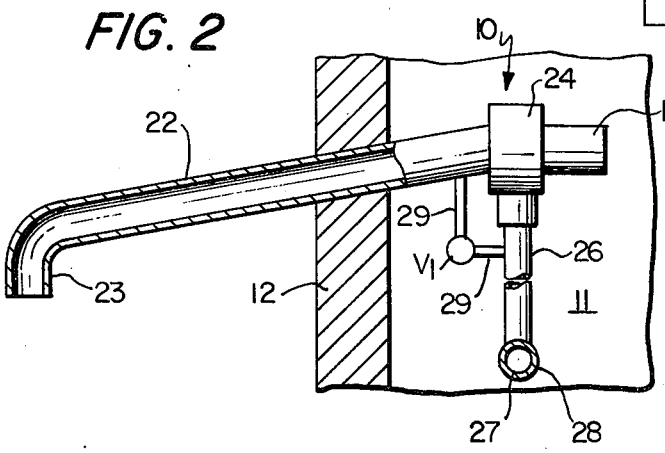
FIG. 3

AMBIENT AIR ASSIST FOR A REFRIGERATOR UNIT

Background of the Invention

1. Field of the Invention

This invention relates generally to a system for supplying ambient air at a controlled rate to a refrigerated enclosure when the ambient temperature is below that within the enclosure.

2. History of the Prior Art

Due to the ever increasing concern over energy conservation, there has been a great deal of effort directed to both altering present refrigeration systems as well as developing new systems which may be more efficiently operated. One area of particular interest which is gaining a new life because of the energy situation is the use, under proper climatic conditions, of ambient air to reduce the workload of conventional refrigeration equipment.

The concept of storing perishable goods in locations where proper cooling is maintained or assisted by climatic or ambient conditions is as old as the traditionally known and still frequently used root cellar. However, with the advent of mechanical refrigeration techniques, the use of root cellars, ice lockers, cold boxes, and the like quickly subsided. People looked primarily to the mechanical refrigerating units which could afford greater protection and more accurate temperature control over stored goods than was before possible.

The theory of assisting mechanical refrigerating units by using ambient air was soon proposed and subsequently many attempts were made to develop reliable assist systems which could easily and inexpensively be applied or combined with conventional refrigerating equipment.

To realize the potential savings in energy which is possible by using ambient air in the operation of household or commercial refrigerators, walk-in refrigerating units, coolers and the like, one need only consider the general climatic conditions of the northern hemisphere. For example, in some northern portions of the United States temperatures of freezing or below are encountered 150 days or more out of the year. Further, many refrigeration systems are operated at temperatures well above freezing, the desired temperature being dependent upon the goods being stored. Therefore, by developing refrigeration systems which can utilize ambient air to achieve or maintain the temperature within various refrigeration systems at appropriate levels, the workload in number of hours of equipment operation alone may be drastically reduced and thereby a beneficial savings of energy achieved.

One problem associated with the use of ambient air to cool refrigerated enclosures is that meats, vegetables, liquids, medicines, or other stored goods may be inadvertently subjected to extremely low temperatures which may adversely affect the quality of the product or even destroy the same. For instance, a super market meat storage locker is desirably maintained at temperatures slightly above 0° C so that the growth of bacteria is slowed while the meat is prevented from freezing. In the operation of some conventional ambient air supply systems, if the ambient air being conducted into the particular refrigerated enclosure is well below 0° C, for instance −15° C, the interior temperature will drop too rapidly for the system's controls to react to reduce or stop the flow of the cold air. In such cases, some of the meat, or other products stored, may be inadvertently damaged as by partial or total freezing, when subjected to such extremely cold temperatures.

Some examples of the prior art include U.S. Pat. Nos. 2,488,518 to Zucker; 2,855,839 to Teiger; 3,546,893 to Frudeger; and 3,739,980 to Andersen.

SUMMARY OF THE INVENTION

A system for supplying ambient air to a refrigerated enclosure which includes at least two separate ambient air supply units which are independently controlled for operation over different temperature ranges and which are connected to the interior temperature control system for the refrigerated enclosure so that the rate of ambient air flow into the enclosure is proportional to the temperature difference between the ambient air and the temperature within the enclosure.

It is an object of this invention to provide an ambient air supply system to supplement the operation of conventional refrigeration equipment so as to reduce the workload on the refrigeration evaporator system when ambient temperatures are equal to or below that desired to be maintained within the equipment.

It is a further object of the invention to provide a system of ambient air supply which is quickly and easily adapted to a conventional refrigerated enclosure in such a manner that the rate of ambient air flow into the enclosure is decreased as the difference between the temperature of the ambient air and the normal operating temperature within the enclosure is increased.

It is another object of the invention to provide an ambient air supply system having multiple air supply apparatuses which not only regulate the rate of ambient air supply into the enclosure but also insure a secondary or backup supply system should some electrical or mechanical failure occur to one of the apparatuses.

BRIEF DESCRIPTION OF THE DRAWING

FIG. 1 is an illustration showing the embient air supply system as installed in a conventional walk-inrefrigerating unit.

FIG. 2 is a section taken along line 2—2 of FIG. 1.

FIG. 3 is an electrical diagram of the temperature control system of the invention.

Description of the Preferred Embodiment

With continued reference to the drawing, the ambient air supply system 10 is shown as being installed in a conventional walk-in refrigerator enclosure or cooler 11. It should be noted, however, that the invention is not limited to use in a walk-in type refrigerating unit, but could be used with many types and styles of refrigeration equipment.

The refrigerator enclosure 11 includes a back or side wall 12 through which the ambient air supply system 10 is mounted. Entry to the enclosure is possible through a door or similar opening (not shown). In order to permit the warmer air which rises within the enclosure to escape as the need develops, a louvered vent 13 is installed adjacent the upper portion of the wall 12.

In reference to FIG. 3, it will be noted that the refrigerated enclosure is normally cooled by a conventional mechanical refrigeration system 14 which includes an evaporator 15, compressor 16, and condenser 17 which are connected via a refrigerant line 18. The mechanical system operates in direct response to a thermostatic device $T_1$ which is mounted interiorly of the refrigerator enclosure to monitor the temperature therein. The thermostatic device $T_1$ electrically connects a source of power to a compressor drive motor $M_1$ in a manner which will be described in the following paragraphs.

The ambient air supply system 10 includes a primary ambient air supply unit 20 and at least one secondary air supply unit 21. The units 20 and 21, although subject to response or operation by different controls, are structurally similar. Each of the air supply units 20 and 21 includes an intake duct 22 which extends through the wall 12 to provide channels or conduit means for bringing the ambient air into the refrigerator 11. Each of the intake ducts 22 is sloped downwardly as it extends outwardly from the wall 12 and further includes downwardly disposed nozzle portions 23 which may be attached to or integrally formed in the outermost portion thereof. The slope of the air ducts and their downwardly disposed nozzles aid in preventing the entrance of moisture into the refrigerator and also allow any condensation which forms along the interior of the ducts to be naturally drained therefrom. If desired, a filter (not shown) may be located within the duct 22 to remove foreign particles from the incoming ambient air.

Interiorly of the refrigerator wall 12, the air ducts 22 are connected to fans 24 and 25 which are independently driven by motors $M_2$ and $M_3$, respectively. Outside air which is drawn through the ducts by the fans 24 and 25 is discharged therefrom via connecting ducts 26 to a common ambient air discharge header 27. The air being forced into the common header 27 is dissipated outwardly into the refrigerator through a plurality of discharge vents or orifices 28 which are spaced along the length of the header. Although the discharge orifices are shown as being generally aligned along the header, their spacing may be staggered or otherwise spaced around the header to more evenly distribute the ambient air as it is discharged into the refrigerator unit. Each of the discharge orifices may be threaded to selectively receive screw plugs (not shown). In the event it becomes necessary to further restrict or control the flow of ambient air into the refrigerated enclosure the plugs could be easily inserted in any number of selected orifices, thereby prohibiting the flow of air through such selected orifices.

As shown in FIG. 3, high pressure relief lines 29 may be provided in some forms of the invention. The relief lines extend from each of the connecting ducts 26 to the respective intake ducts 22 at a point adjacent the intake side of the fans 24 and 25. A pressure responsive valve $V_1$ is mounted along each of the relief lines so as to permit a portion of the air being discharged by the fan to be returned to the intake side of the fan when pressures along the discharge header 27 or connecting duct 26 are above a desired level.

The relief lines are provided so as to permit the fan motors $M_1$ and $M_2$ to operate at a generally constant speed and reduce the amount of stress which might otherwise be encountered by the motors when the pressure in the discharge lines is increased due to either accidental or selective blockages. For instance, as a result of selectively plugging the discharge orifices, the back pressure to the discharge side of the fans may be increased. In order to relieve this back pressure and permit the motors to continue operating at a relatively constant speed and under a generally uniform load, the pressure relief valves $V_1$ open and a portion of the ambient air being discharged via the connecting ducts is recycled through the relief line to the intake side of the fans.

Normally the air ducts 22 are the same size, and the fans 24 and 25 are of similar rating so that the amount of air being conducted by each unit is the same, although it may be desirable, under some conditions, to use differently sized ducts and/or fans. However, by utilizing generally identical equipment for each of the ambient air supply units 20 and 21, the air flow rate into the refrigerator enclosure is merely a simple multiple of the number of units which are used in the system. In the preferred, embodiment, it can be seen that the air flow rate through the discharge header is twice as great when both units are operating than when one unit is operating.

The operation of each of the fans 24 and 25 by their respective motors $M_2$ and $M_3$ is regulated in response to both common and separate thermostatic devices. As shown in the schematic electrical diagram of FIG. 3, the motor $M_2$ is electrically connected to a thermostatic device $T_2$ via switch $S_2$, and the motor $M_3$ is electrically connected to a thermostatic device $T_3$ via switch $S_3$. Both the thermostatic devices $T_2$ and $T_3$ are mounted exteriorly of the refrigerator wall 12 so as to operate to open or close the respective motor control swtiches $S_2$ and $S_3$ in response to ambient temperature conditions.

The separate ambient temperature controls for the supply units 20 and 21, which include the thermostatic switch combinations of $T_2 - S_2$ and $T_3 - S_3$, are electrically connected in series to the thermostatic device $T_1$. Such a connection permits the operation or control of the motors $M_2$ and $M_3$ to be dependent upon temperature conditions both interiorly and exteriorly of the refrigerated enclosure.

When switch $S_1$ is closed in response to thermostatic device $T_1$, power is supplied to either the mechanical refrigeration system 14 or to the ambient air intake system 10 dependent upon the position of switch $S_2$. Switch $S_2$ is either connected via its normally closed terminal 30 to motor $M_1$ or via its normal open terminal 31 to motors $M_2$ and $M_2$. Therefore, when the thermostatic device $T_1$ senses that the temperature in the regrigerating unit is above a predetermined level, switch $S_1$ is closed and current is supplied to switch $S_2$. The thermostatic device $T_2$ senses the temperature exteriorly of the regrigerator and if such temperature is below that within the enclosure $T_2$ switch $T_2$ will be caused to close on terminal 31 thereby permitting the current to flow to either of the motors $M_2$ or $M_3$. However, when weather conditions are such that the ambient air temperature is above the desired temperature at which the refrigerator is to be maintained, thermostatic device $T_2$ permits switch $S_2$ to remain in its normally closed position in contact with terminal 30 so that current passing through the switch $S_1$ will flow to the mechanical refrigeration system motor $M_1$.

Due to the desire to regulate the rate of ambient air flow into the refrigerator when power is supplied to the ambient intake system 10, the thermostatic devices $T_2$ and $T_3$ are preset to open and close their respective switches $S_2$ and $S_3$ over different temperature ranges. As discussed above, when the temperature of the ambient air is below the temperature at which it is desired to maintain the refrigerating unit, the thermostatic device $T_2$ will activate switch $S_2$ to contact terminal 31. Then if switch $S_1$ is closed due to the need to lower the temperature within the refrigerator, power is immediately supplied to the first ambient air supply unit 20 through the activation of motor $M_2$. It will be noted, however, that the second ambient air supply unit 21 is only thereafter actuated when its thermostatic device $T_3$ permits switch $S_3$ to be closed allowing current to flow through the motor $M_3$.

Due to the possible danger of excessively cooling or too rapidly refrigerating the interior of the refrigerator with too great a flow rate of extremely cold ambient air, the thermostatic device $T_3$ is preset to open the normally closed switch $S_3$ if the ambient air temperature is below a desired level. Therefore the control of the secondary ambient air supply unit 21 is such that switch $S_3$ is normally closed and the motor $M_3$ is powered at the same time the primary unit 20 is operated unless or until the ambient air temperature is below a desired minimum. Thus, when the ambient air is too cold, thermostatic device $T_3$ will cause switch $S_3$ to open, cutting the power to the secondary unit and effectively and immediately reducing the ambient air flow rate into the refrigerator enclosure.

From the foregoing, it may be seen that the ambient air supply units 20 and 21 may be effectively used to reduce the work-load and power drain to conventional mechanical refrigeration systems by permitting the refrigerator temperatures to be maintained through the use of ambient air. In use, the control temperatures of the thermostatic devices $T_1$ and $T_2$ are preset at the same level, that level being dependent upon the temperature at which it is desired to maintain the refrigerator enclosure. However, switch $S_1$ is not closed to allow current to enter the motor control circuit until the temperature within the enclosure is above the level set on the thermostatic device $T_1$. Switch $S_2$, on the other hand, will remain in its normally closed contact with terminal 30 unless or until the preset temperature level is registered exteriorly of the enclosure. Therefore, if both the inside and outside temperatures are above the present level, current will be supplied via switches $S_1$ and $S_2$ through terminal 30, and to the mechanical refrigeration system compressor motor $M_1$.

If, however, the temperature of the ambient air is below that of the present temperature level of thermostatic devices $T_1$ and $T_2$, cold air may be supplied by one or both of the ambient air supply units 20 and 21. In such instances, the thermostatic device $T_2$ activates switch $S_2$ to make contact with terminal 31 and thereby close the circuit to one side of motors $M_2$ and $M_3$. The motors $M_2$ and $M_3$ in turn power the fans 24 and 25 which force ambient air into the refrigerator enclosure through the discharge header 27. The operation of at least the primary unit 20 is continued until either the temperature inside the enclosure is low enough to cause thermostatic device $T_1$ to open switch $S_1$ or until the temperature outside goes above the preset level and thermostatic device $T_2$ permits switch $S_2$ to return to its normally closed position.

In the event the outside air is extremely cold, as for instance, below 0° C, the rate of ambient air supply through both the primary and secondary supply units 20 and 21 may lower the enclosure temperature so rapidly that various stores goods may be damaged. Therefore, the primary and secondary ambient air supply units are selectively and separately activated depending upon the outside temperature. Activation of the primary unit switch $S_2$ to contact with terminal 31 is initiated at the preset level at which the interior of the refrigerator is to be maintained and remains aactivated at any temperature below the preset temperature. However, the secondary unit will cut off when ambient temperatures are too low.

Therefore, during operation of the ambient air supply system, if the ambient temperatures are not too low, the air flow into the refrigerator enclosure will be through both the primary and secondary units. However, if the ambient temperature is too low, $T_3$ will open switch $S_3$ and the secondary ambient air supply unit will shut down.

As was previously noted, the rate of air flow into the enclosure under appropriate conditions varies as a direct proportion to the number of ambient air supply units installed. If a third or fourth unit is desired to further regulate the rate of air supply into the enclosure, each unit would include a thermostatic device and motor switch which would be connected in series with switch $S_3$. As in the case of the secondary unit 21, each of any additional units installed would be sensitive to increasingly lower temperatures to thereby create a series of air supply units which would operate as a system to sequentially reduce the rate of ambient air flow into the enclosure as colder ambient temperatures are encountered.

I claim:

1. An apparatus for use in supplying ambient air to a refrigerated enclosure comprising a primary and at least one auxiliary ambient air supply means, said primary and auxiliary ambient air supply means being selectively operable to supply ambient air into the refrigerated enclosure when the ambient air temperature is below a first temperature but above a second temperature, said auxiliary ambient air supply means being operably disconnected from said primary ambient air supply means to stop the supply of ambient air therethrough into the refrigerated enclosure when the ambient air temperature is below the second temperature, whereby the rate of flow of ambient air into the refrigerated enclosure is reduced as said auxiliary ambient air supply means is disconnected in response to colder ambient air temperatures.

2. The invention of claim 1 in which each of said primary and auxiliary ambient air supply means includes air duct means disposed through a wall of the refrigerated enclosure, fan means mounted on said air duct means, and means for connecting each of said fan means to a common ambient air distributor header means disposed within the refrigerated enclosure.

3. The invention of claim 2 in which said air duct means are downwardly inclined along their length extending outwardly from the refrigerated enclosure.

4. Apparatus for refrigerating a zone which is insulated from ambient medium whose temperature varies from above to below that desired for the zone, comprising refrigeration means in heat exchange relation with the zone, primary and auxiliary means for cooling the zone using the ambient medium when the ambient temperature is below that desired in the zone, first temperature responsive means within the zone, second and third temperature responsive means within the ambient medium, said primary means operative to supply ambient medium to the zone when said second temperature responsive means indicates a temperature below that desired in the zone and said first temperature responsive means indicates a temperature above that desired in the zone, said auxiliary means being operative to supply ambient medium to the zone simultaneously with said primary means except when said third temperature responsive means indicates a temperature below a predetermined value below that desired in the zone, and said refrigeration means being operative to cool said zone when both said second and third temperature responsive means indicate a temperature above that desired in said zone.

5. An apparatus for supplying ambient air to a refrigerated enclosure having a mechanical refrigeration means and an enclosure temperature responsive means, comprising a primary and at least one secondary ambient air supply means having primary and secondary ambient air supply control means, respectively, said primary ambient air supply control means including a first ambient air temperature responsive means connected to a first switch means, said first switch means being selectively connected between the enclosure temperature responsive means and one of said primary ambient air supply means and the mechanical refrigeration means, said first ambient air temperature responsive means being responsive to a first ambient air temperature to operatively connect said primary and secondary ambient air supply means to the enclosure temperature responsive means when the ambient air temperature is below said first ambient air temperature and alternatively operatively connect the refrigeration means to the enclosure temperature responsive means when ambient air temperature are above said first ambient air temperature, said secondary ambient air supply control means including second ambient air temperature responsive means, said second ambient air temperature responsive means being responsive to a second ambient temperature below said first ambient air temperature to operatively disconnect said secondary air supply control means from said primary air supply control means when the ambient air temperature is below said second ambient air temperature, whereby the flow rate of ambient air into the enclosure which is initiated in response to the enclosure temperature responsive means when ambient air temperature is below said first ambient air temperature is reduced in response to lower ambient air temperatures below said second ambient air temperature.

6. An apparatus for use in supplying ambient air to a refrigerated enclosure which enclosure has a mechanical refrigeration means and an enclosure temperature responsive means comprising, a primary and at least one auxiliary ambient air supply means, said primary and auxiliary ambient air supply means being selectively operable to supply ambient air into the refrigerated enclosure when the ambient air temperature is below a first temperature but above a second temperature, said auxiliary ambient air supply means being operably disconnected from said primary ambient air supply means to stop the supply of ambient air therethrough into the refrigerated enclosure when the ambient air temperature is below the second temperature, said primary air supply means including primary ambient air supply control means having first ambient air temperature responsive means connected to a first switch means, said first switch means operatively connecting one of said primary ambient air supply means and the refrigeration means to the enclosure temperature responsive means, said first ambient air temperature responsive means being responsive to the ambinet air temperature to cause said switch means to connect said primary ambient air supply means to the enclosure temperature responsive means when the ambient air temperature is below said first ambient air temperature and to alternatively connect the refrigeration means to the enclosure temperature responsive means when ambient air temperature is above said first ambient temperature.

7. The invention of Claim 6 in which said auxiliary ambient air supply means includes auxiliary ambient air supply control means having second ambient air temperature responsive means connected to second switch means, said second switch means being connected to said first switch means when the ambient air temperatures are above said second ambient air temperature and being disconnected therefrom when ambient air temperatures are below said second ambient air temperature.

* * * * *